United States Patent [19]

Peet

[11] Patent Number: 4,915,306

[45] Date of Patent: Apr. 10, 1990

[54] ON-LINE PULVERIZER COORDINATION ADJUSTMENT FOR MULTIPLE COALS

[75] Inventor: William J. Peet, Cambridge, Canada

[73] Assignee: The Babcock & Wilcox Company, New Orleans, La.

[21] Appl. No.: 323,578

[22] Filed: Mar. 14, 1989

[51] Int. Cl.[4] ..... B02C 19/00; B02C 25/00

[52] U.S. Cl. ..... 241/18

[58] Field of Search ..... 241/18, 19, 33, 30, 241/34

[56] References Cited

U.S. PATENT DOCUMENTS 4,478,371 10/1984 Williams ..... 241/18

4,498,632 2/1985 Ruter ..... 241/18

4,518,123 5/1985 Tanaka et al. ..... 241/18

4,770,350 9/1988 Székely et al. ..... 241/18 X

*Primary Examiner*—Timothy V. Eley

*Attorney, Agent, or Firm*—Vytas R. Matas; Robert J. Edwards

[57] ABSTRACT

A method of controlling the operation of a pulverizer includes detecting the type of fuel being supplied to the pulverizer. At least one characteristic of the fuel is determined by a combination of measurements and calculations. One characteristic is moisture content which distinguishes one type of fuel, in particular, one type of coal, from another. The feeding rate of the fuel to the pulverizer is selected from a curve which plots primary air flow against percentage of rating for the pulverizer. This curve is constant for the pulverizer despite the types of fuel used.

4 Claims, 3 Drawing Sheets

ON-LINE PULVERIZER COORDINATION ADJUSTMENT FOR MULTIPLE COALS

FIELD AND BACKGROUND OF THE INVENTION

The present invention relates in general to the control of pulverizers for coal fired steam generators and, in particular, to a new and useful method and apparatus for adjusting the relationship between the mass flow of coal through the pulverizer to the primary air flow of the pulverizer, according to changes in the properties of the coal, in order to maintain an optimum performance for the pulverizer.

In a steam generator which utilizes a pulverizer for supplying coal or other fuel thereto, a small portion of the air required for combustion is used to transport the coal to burners or other structures for burning the fuel in the steam generator. This is known as primary air. In direct fire systems, primary air is also used to dry the coal in the pulverizer. The remainder of the combustion air is introduced at the burner and is known as secondary air.

The current technique for the control of a pulverizer in a coal fired steam generator plant is achieved by the use of a "coordination curve" which relates the primary air flow to the pulverizer with the required mass flow of coal through the pulverizer. The coordination curve is based on the grindability of the raw coal and the outlet fineness required to achieve efficient combustion in the steam generator. Thus, this curve defines the maximum and minimum coal flow capabilities of the pulverizer under the above conditions. Primary air temperature is controlled by dampers to achieve the prescribed coal drying from a set outlet temperature of the pulverized coal/air mixture.

Normally, the design coordination curve is adjusted during commissioning or operation to reflect the actual fuel properties (e.g. coal grindability) encountered and a classifier is adjusted to provide the outlet fineness required in the pulverizer.

Some steam generating stations use more than one coal supply and do not reset or re-adjust the pulverizer when a change in coal supply occurs. Under these circumstances, the coordination curve used in the pulverizer control loop must be a comprise among the intended fuels. This results in less than optimum conditions for the pulverizer, affecting combustion efficiency, turndown capability and response rate during load changes.

U.S. Pat. No. 4,528,918 to Sato et al discloses a method of controlling combustion which is fueled by one or more pulverizers that are supplied with primary air which conveys pulverized coal to burners that are supplied with secondary air for burning the coal.

U.S. Pat. No. 4,518,123 to Tanaka et al discloses a method of controlling a pulverizer which utilizes a push blower on the input side of the pulverizer and a pull blower on the output side of the pulverizer.

U.S. Pat. No. 4,424,766 to Boyle discloses a fluidized bed combustor, which is capable of using a variety of different coals. No mechanisms are disclosed for varying the operating parameters of the equipment according to the type of coal utilized, however.

U.S. Pat. No. 4,116,388 to Trozzi discloses a pulverized fuel burner which utilizes primary air that is conveyed along with the pulverized fuel and secondary air which is independently supplied to the burner.

Currently, problems are encountered when variations in fuel source occur. These problems are more prevalent in overseas utilities where different fuel sources are normally used.

SUMMARY OF THE INVENTION

The present invention relates to a technique which can alleviate many of the problems encountered due to variations in fuel source. According to the present invention, a variation in the fuel source is detected and utilized to control the operation of the pulverizer for supplying the fuel. Calculations performed on actual steam generators demonstrates the ability of the invention to distinguish between three current fuels (Bukit Asam, Australian and Chinese). The present invention is particularly useful where different fuel sources are normally used.

The invention provides means to automatically distinguish the change in fuel properties and thereby adjust the coal flow/air flow relationship to maintain optimum pulverizer performance.

For a given pulverizer, there exists an air flow versus percentage of rating (P.O.R.) curve which is constant for that pulverizer. The present invention uses this fixed relationship in the pulverizer control loop in place of the coordination curve. In order to produce a mass flow demand for the coal feeder (i.e., inlet coal flow to the pulverizer) a relationship between the P.O.R. and coal mass flow for each intended fuel must be developed.

One method, described herein, which can be used for distinguishing among fuels is from raw coal moisture. This is particularly true for coals of different rank (e.g., subbituminous and bituminous).

The determination of raw coal moisture can be achieved by the normal instrumentation provided in a pulverized coal system by means of a heat balance.

Neglecting the heat loss from the pulverizer and the heat input from the pulverizer drives, the total heat-in is equated to the heat-out of the pulverizer (in the flow streams) at equilibrium conditions.

$$\text{Heat In} = W_A C_{PA}(T_{IN} - 32) + W_{MA1} H_{IN} + W_C C_{PC}(T_C - 32) + W_{MC1} C_{PW}(T_C - 32) \quad (1)$$

$$\text{Heat Out} = (T_{OUT} - 32)[W_A C_{PA} + W_C C_{PC} + W_{MC2} C_{PW}] + W_{MA2} H_{OUT} \quad (2)$$

Where:

| | | |
|---|---|---|
| $W_A =$ | Mass flow of dry air | lbs/hour |
| $W_{MA1} =$ | Mass flow of moisture in air entering pulverizer | lbs/hour |
| $W_{MA2} =$ | Mass flow of moisture in air leaving pulverizer | lbs/hour |
| $W_C =$ | Mass flow of dry coal | lbs/hour |
| $W_{MC1} =$ | Mass flow of moisture in coal entering pulverizer | lbs/hour |
| $W_{MC2} =$ | Mass flow of moisture in coal leaving pulverizer | lbs/hour |
| $T_{IN} =$ | Primary air temperature entering pulverizer °F. | |
| $T_{OUT} =$ | Pulverized coal/air mixture leaving pulverizer °F. | |
| $T_C =$ | Raw coal temperature entering pulverizer °F. | |
| $C_{PA} =$ | Specific heat of dry air | Btu/lb °F. |
| $C_{PC} =$ | Specific heat of dry coal | Btu/lb °F. |
| $C_{PW} =$ | Specific heat of water | Btu/lb °F. |
| $H_{IN} =$ | Enthalpy of moisture in air entering pulverizer | Btu/lb |
| $H_{OUT} =$ | Enthalpy of moiture in air leaving | |

-continued

| pulverizer | Btu/lb |
|---|---|

An example of this technique can be used for illustration as follows:

Consider the operation of a pulverizer on a low moisture bituminous type coal.

The mass flow of moisture in the primary air entering the primary air system remains constant as the air is heated and raised in pressure prior to its entry to the pulverizer.

(Typically for ambient air at 80° F. and 60% relative humidity, the moisture content would be 0.013 lbs. moisture/lb dry air, a relatively small fraction).

Bituminous coals generally have low moisture contents (less than 15% by weight), the major portion of which is evaporated in the pulverizer (typically the residual moisture in pulverized bituminous coals leaving the pulverizer would be less than 2% by weight). Consequently, the following simplifying assumptions could be made for this case:

| | |
|---|---|
| $W_{MA1}$ and $W_{MC2}$ are zero | (i.e. zero moisture in air entering the pulverizer and zero moisture in pulverized coal leaving the pulverizer). |
| Then $W_{MA2} = W_{MC1}$ | (i.e. all the moisture in the coal entering is evaporated into the air). |

From this, the equations (1) and (2) become:

$$\text{Heat In} = W_A C_{PA}(T_{IN}-32) + W_C C_{PC}(T_C-32) + W_{MC1} C_{PW}(T_C-32) \quad (3)$$

$$\text{Heat Out} = (T_{OUT}-32)[W_A C_{PA} + W_C C_{PC}] + W_{MC1} H_{OUT} \quad (4)$$

Equating heat in=heat out−(Conservation of energy) gives $$W_{MC1}[H_{OUT} - C_{PW}(T_C-32)] = W_A C_{PA}(T_{IN}-T_{OUT}) - W_C C_{PC}(T_{OUT}-T_C) \quad (5)$$

Dividing both sides of the equation by $W_C^*$ where $W_C^* = W_C + W_{MCl}$ (which is the wet coal flow measured by the feeder).

We obtain:

$$\frac{W_{MCl}}{W_C^*}[H_{OUT} - C_{PW}(T_C - 32)] = \frac{W_A}{W_C^*} C_{PA}(T_{IN} - T_{OUT}) - \frac{W_C}{W_C^*} C_{PC}(T_{OUT} - T_C) \quad (6)$$

Where: $\frac{W_{MCl}}{W_C^*}$ = Moisture fraction of raw coal feed.

$\frac{W_A}{W_C^*}$ = Air/fuel ratio as measured by pulverizer instrumentation $\frac{W_C}{W_C^*} = 1 -$ Moisture fraction of raw coal, i.e. $1 - \frac{W_{MCl}}{W_C^*}$ Simplifying the equation (6):

$$\frac{W_{MCl}}{W_C^*} = \frac{W_A/W_C^* C_{PA}(T_{IN} - T_{OUT}) - C_{PC}(T_{OUT} - T_C)}{[H_{OUT} - C_{PW}(T_C - 32) - C_{PC}(T_{OUT} - T_C)]} \quad (7)$$

Thus equation (7) may be written:

$$\text{Moisture fraction in raw coal} = \frac{\text{AIR/FUEL RATIO} \times K_1 \times \delta T_{AIR} - K_2\,\delta\,T_{COAL}}{\delta H\ \text{MOISTURE} - K_2\,\delta\,T_{COAL}}$$

$T_{IN}$, $T_{OUT}$ $T_C$ are measured [$T_C$=ambient temperature]

Air/fuel ratio is available from primary air flow transmitter and feeder flow transmitter.

$\delta H \approx [(T_{OUT}+2311)\ 0.458-(T_C-32)]$ Btu/lb.

$K_1$ and $K_2$ are constants for $C_{PA}$ and $C_{PC}$

Using this moisture calculation will distinguish the coal being used and thus the correct P.O.R. versus coal flow can be selected based on the pulverizer design calculations for the specific coal grindability and fineness.

In addition, the pulverizer outlet temperature setpoint may be automatically adjusted, if necessary, for optimum combustion efficiency.

The advantages of the invention are:

(1) The optimum coal/air characteristics are maintained automatically for each fuel type without requiring re-calibration and adjustments.

(2) The coal can be identified to the operator to signal changes in the operation of the unit which may be necessary due to the changes in combustion, slagging, fouling, etc., experienced with the different fuels. This could be altering the sootblower programs, changing excess air or providing a signal to steam temperature control for adjusting feed forward or gains, etc., to provide improved control and response.

(3) The ability of the pulverizer to adjust to differing fuels maintains optimum load change capability which is not compromised such as is the case with a single coordination control for all fuels.

(4) Optimum combustion characteristics are maintained at the burners for each fuel type thereby reducing unburned combustible loss and minimizing carbon in the ash.

The inventive technique can be applied to a number of coal characteristics (other than the moisture content) which can be distinguished by interrogation of the pulverizer operation to discriminate among the different fuels which are being used. Such indicators as heating value (from the Btu calibration) and pulverizer motor power could be used as indicators to the system.

Accordingly, an object of the present invention is to provide a method of controlling the operation of a pulverizer for use in pulverizing a plurality of types of fuels, the pulverizer having a constant primary air flow to percent of rating curve, comprising: feeding one of the fuels to the pulverizer to be pulverized; feeding primary air to the pulverizer for conveying the pulverized fuel; determining at least one characteristic of the fuel being fed, which characteristic is indicative of the fuel type; selecting a mass flow demand from the curve according to the type of fuel being fed; and controlling the feeding of the one fuel according to the mass flow demand selected from the curve.

A further object of the present invention is to provide a method which is sensitive to the type of fuel and, in particular, to the type of coal being fed to the coal pulverizer to maximize the operation of the pulverizer.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
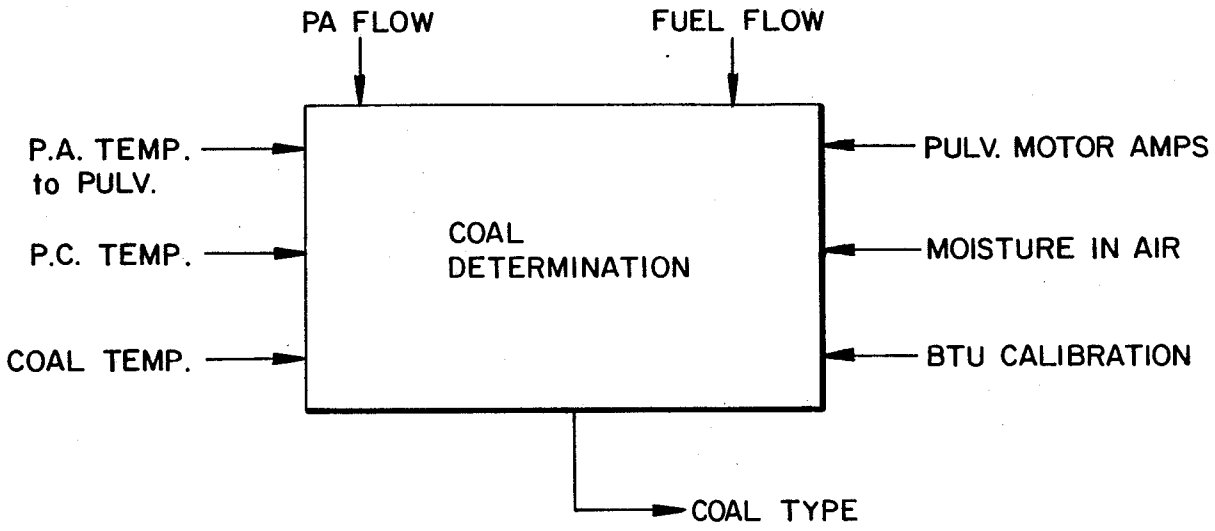
FIG. 1 is a schematic representation of the method of the present invention.

Referring to the drawings in particular, the invention embodied in FIG. 1 comprises a method of operating a pulverizer which can be used with a plurality of fuel types, wherein the type of fuel, in this case the type of coal, is determined by calculating at least one characteristic of the coal which is indicative of its type. The coal determination relies on the primary air (PA) flow, the fuel flow, the primary air (P.A.) temperature to the pulverizer, the coal temperature to the pulverizer (P.C. TEMP. and COAL TEMP.), the power used to operate the pulverizer motor (PULV. MOTOR AMPS), the moisture in the air and a BTU calibration. These parameters are useful in determining the moisture content of the coal which is one characteristic of the coal that can be determined to determine its type, as used in the above calculations.

Figure 2:
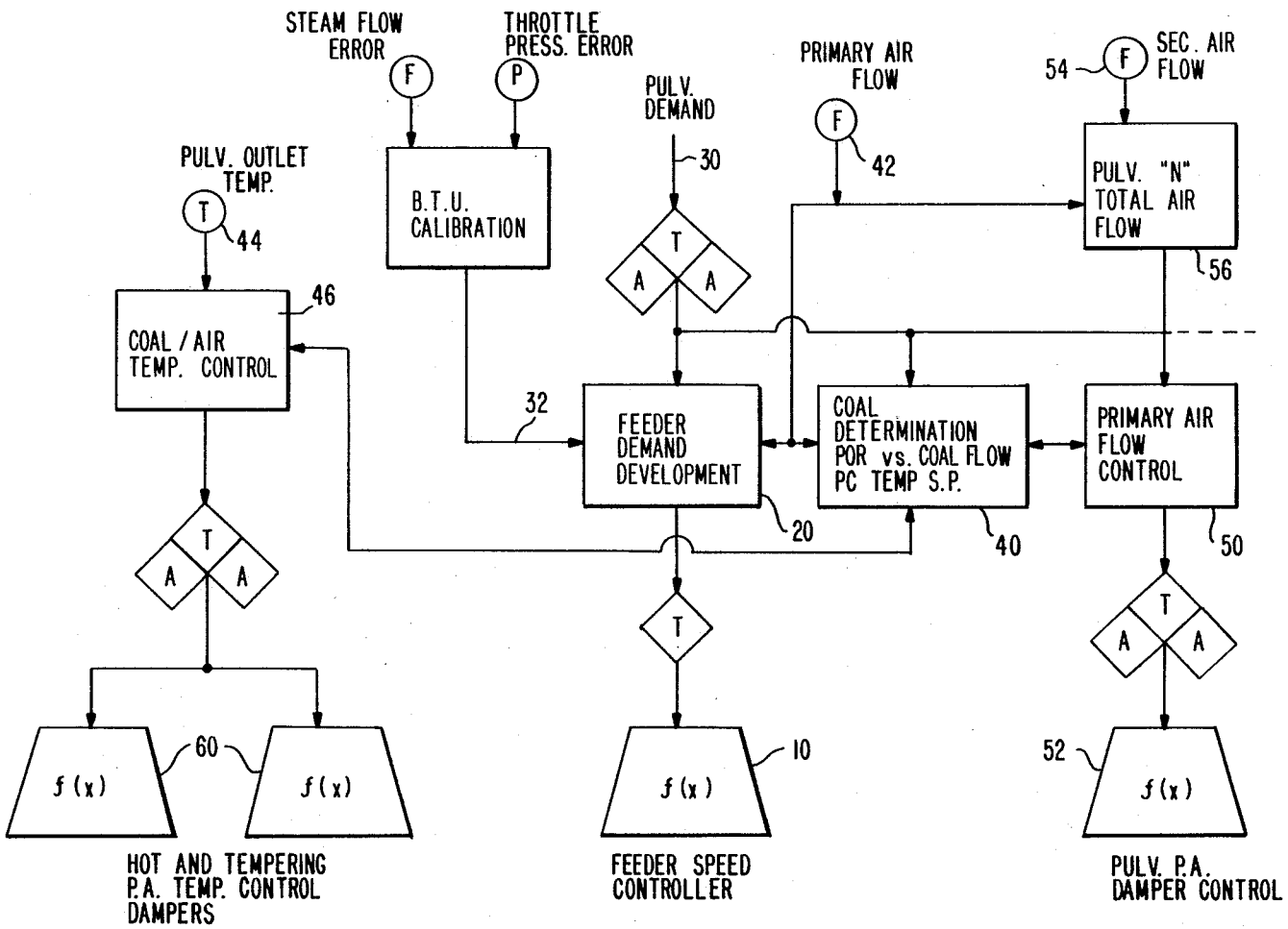
FIG. 2 is a block diagram showing the operation of the present invention in a steam generator.

FIG. 2 shows the operation of a pulverizer system control with the present invention. The individual pulverizer demand 30 is generated from the total energy demand of the steam generator and is well know to those familiar with pulverized coal fired steam generators. The pulverizer demand 30 is the primary signal used to develop the require speed of the coal feeder for delivery of raw coal flow to the pulverizer and the primary air flow to the pulverizer. The pulverizer demand 30 is adjusted in the feeder demand development stage 20 by the Btu calibration 32 and this adjusted coal flow signal is given to the feeder speed controller 10. The feeder speed controller 10 selects the speed of the feeder to provide the required flow of raw coal to the pulverizer. The Btu calibration 32 provides an adjustment based on the steam generator steam flow and pressure errors, between the actual values and those required., as is well known by those familiar with the art.

The coal flow demand signal generated in the feeder demand development 20 is passed to the coal determination stage 40 which may be of the type illustraded in FIG. 1.

The determination of the type of coal being fed to the pulverizer by the coal feeder is calculated as a function of the feeder coal flow , the primary air flow detected at 42, the pulverizer outlet temperature detected at 44 and the other parameters as shown in FIG. 1. The coal determination is also utilized to influence a primary air flow control 50 which produces a signal for the pulverizer primary air damper control 52. A secondary air flow 54 can also be detected for determining the total air flow to the burners associated with the pulverizer at 56.

Coal/air temperature control 46 compares the actual temperature with a set point value and generates a signal which operates hot and tempering primary air temperature control dampers 60. The set point value may be modified by the coal determining stage 40, which provides the new value to the coal/air temperature control 46.

Figure 3:
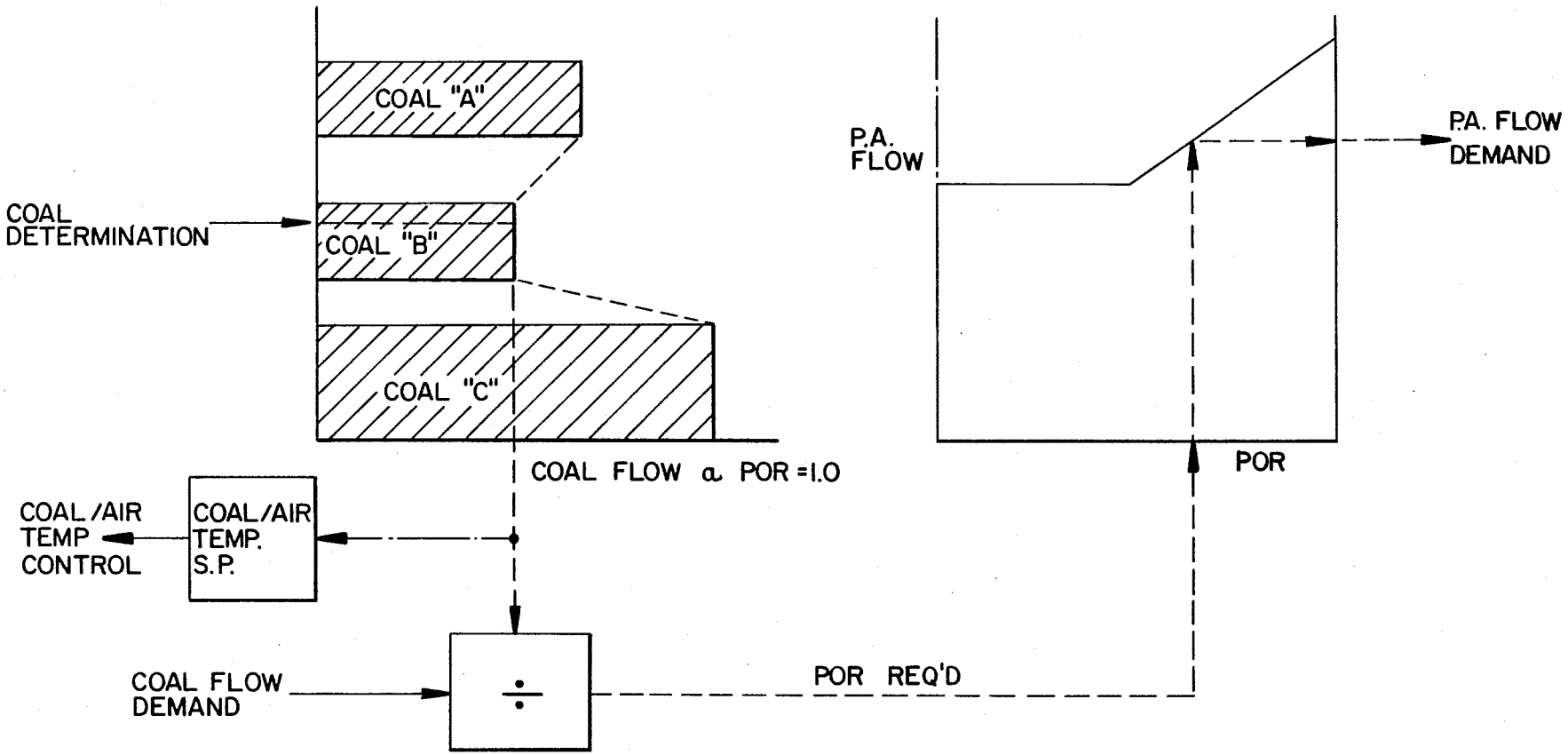
FIG. 3 is an illustrative diagram showing how the moisture calculation of coal for the pulverizer can be utilized to characterize the coal and control the operation of the pulverizer.

FIG. 3 shows how the present invention can be utilized to identify which of three coals are being supplied to the pulverizer. The three coals are identified as coal "A", "B" and "C". They each have a different characteristic which can be determined and which yields a different flow rate at "POR" equal to 1.0.

The coal determination operation illustrated in FIG. 1, indicates which of the coals is present, in this case, "B", in FIG. 3. This is provided as a signal to be combined with the coal flow demand. The output of this combined signal is applied to the primary air flow versus POR curve to yield a primary air flow demand which is used in conjunction with the coal flow demand for the particular coal determined by the present invention.

While a specific embodiment of the invention has been shown and described in detail to illustrate the application of the principles of the invention, it will be understood that the invention may be embodied otherwise without departing from such principles.

What is claimed is:

1. A method of controlling the operation of a pulverizer for use in pulverizing a plurality of types of fuels, the pulverizer having a constant primary air flow to percent of rating curve, comprising:

feeding one of the fuels to the pulverizer to be pulverized;

feeding primary air to the pulverizer for conveying the pulverized fuel;

determining at least one characteristic of the fuel being fed, which characteristic is indicative of the fuel type; and selecting a mass flow demand from the curve according to the determination of the type of fuel being fed; and controlling the feeding of the fuel according to the mass flow demand selected from the curve.

2. A method according to claim 1, wherein the plurality of fuel types comprise a plurality of types of coal, the characteristic comprising moisture content of the coal.

3. A method according to claim 2, including detecting the mass flow of moisture in the coal entering the pulverizer and the wet coal mass flow at a feeder for feeding the coal to the pulverizer and calculating the moisture in the coal as a function of the mass flow of the moisture in the coal during the pulverizer and the wet coal mass flow at the feeder.

4. A method according to claim 3, including calculating the total heat into and out of the pulverizer as a measure of the moisture in the coal.

* * * * *